US009552723B2

(12) United States Patent
Witkowski et al.

(10) Patent No.: US 9,552,723 B2
(45) Date of Patent: Jan. 24, 2017

(54) TRAINABLE TRANSCEIVER SYSTEMS AND METHODS FOR CHANNEL FREQUENCY OFFSET ADJUSTMENT

(71) Applicant: GENTEX CORPORATION, Zeeland, MI (US)

(72) Inventors: Todd R. Witkowski, Zeeland, MI (US); Chris H. Vuyst, Zeeland, MI (US); Thomas S. Wright, Holland, MI (US); Steven L. Geerlings, Holland, MI (US)

(73) Assignee: GENTEX CORPORATION, Zeeland, MI (US)

( * ) Notice: Subject to any disclaimer, the term of this patent is extended or adjusted under 35 U.S.C. 154(b) by 0 days.

(21) Appl. No.: 14/735,890

(22) Filed: Jun. 10, 2015

(65) Prior Publication Data

US 2015/0364033 A1 Dec. 17, 2015

Related U.S. Application Data

(60) Provisional application No. 62/010,914, filed on Jun. 11, 2014.

(51) Int. Cl.
*G08C 17/02* (2006.01)
*G08C 19/28* (2006.01)

(52) U.S. Cl.
CPC ..... *G08C 17/02* (2013.01); *G08C 19/28* (2013.01); *G08C 2201/20* (2013.01); *G08C 2201/50* (2013.01); *G08C 2201/93* (2013.01)

(58) Field of Classification Search
CPC ..... G07C 9/00309; G07C 9/00857; G07C 2009/00793; G07C 9/00182; G07C 2009/00865; G07C 9/00103
USPC ..... 340/5.25
See application file for complete search history.

(56) References Cited

U.S. PATENT DOCUMENTS

| | | | | |
|---|---|---|---|---|
| 5,614,891 | A | 3/1997 | Zeinstra et al. | |
| 2005/0144307 | A1* | 6/2005 | Li | H04L 1/16 709/232 |
| 2008/0016190 | A1* | 1/2008 | Halasz | H04W 16/10 709/220 |
| 2008/0291047 | A1 | 11/2008 | Summerford et al. | |
| 2012/0044087 | A1* | 2/2012 | Johnson | H04W 36/30 340/870.02 |

FOREIGN PATENT DOCUMENTS

| | | | |
|---|---|---|---|
| DE | 1020100 15 104 | A1 | 10/2011 |
| WO | WO-00/75905 | A1 | 12/2000 |

OTHER PUBLICATIONS

International Search Report and Written Opinion of the International Searching Authority in PCT/US2015/015262 dated Jul. 2, 2015, 10 pages.

(Continued)

*Primary Examiner* — Mark Blouin
(74) *Attorney, Agent, or Firm* — Foley & Lardner LLP; Bradley D. Johnson

(57) ABSTRACT

A trainable transceiver for controlling a device includes a transceiver circuit, a control circuit coupled to the transceiver circuit, and memory coupled to the control circuit. The control circuit is configured to receive a signal from the device via the transceiver circuit. The control circuit is configured to determine a frequency of a channel used by the device based on the signal strength of the signal received from the device.

20 Claims, 5 Drawing Sheets

(56) References Cited

OTHER PUBLICATIONS

Transmittal of the International Search Report and Written Opinion of the International Searching Authority, or the Declaration received in PCT/US2015/035133 dated Nov. 26, 2015, 7 pages.

* cited by examiner

```
//                                903.925    903.950    903.975    904.000    904.025    904.050    904.075
U32 BaseHopFreq[7] = { 0x0075310F, 0x00753160, 0x007531B0, 0x00753200, 0x00753250, 0x007532A0, 0x007532F0 };
U8 BaseHopFreqValidDetect;
U8 BaseHopFreqIndex[16] = { 0, 0, 2, 1, 4, 2, 3, 2, 6, 3, 4, 1, 5, 5, 4, 3 };
```

TRAINABLE TRANSCEIVER SYSTEMS AND METHODS FOR CHANNEL FREQUENCY OFFSET ADJUSTMENT

CROSS-REFERENCE TO RELATED APPLICATIONS

This application claims the benefit of U.S. Provisional Application No. 62/010,914, filed Jun. 11, 2014, which is hereby incorporated by reference in its entirety.

BACKGROUND OF THE INVENTION

The present invention relates generally to the field of trainable transceivers for inclusion within a vehicle. A trainable transceiver generally sends and/or receives wireless signals using a transmitter, receiver, and/or transceiver. The wireless signals may be used to control other devices. For example, a trainable transceiver may send a wireless control signal to operate a garage door opener. A trainable transceiver may be trained to operate with a particular device. Training may include providing the trainable transceiver with control information for use in generating a control signal. A trainable transceiver may be incorporated in a vehicle (integrally or contained within the vehicle) and used to control devices outside the vehicle. Some devices which the trainable transceiver may be trained to control may communicate using a frequency which differs from the frequency reported in the specification of the device. It is challenging and difficult to develop a trainable transceiver which may communicate with a device having a communication frequency different from the frequency reported in the specification of the device.

SUMMARY

One embodiment relates to a trainable transceiver for controlling a device includes a transceiver circuit, a control circuit coupled to the transceiver circuit, and a memory coupled to the control circuit. The control circuit is configured to receive a signal from the device via the transceiver circuit. The control circuit is configured to determine a frequency of a channel used by the device based on the signal strength of the signal received from the device.

Another embodiment relates to a method, at a trainable transceiver for controlling a device, for determining a frequency of a channel used by the device. The method includes receiving a transmission for the device at a transceiver circuit. The method includes determining the signal strength of the transmission using a control circuit coupled to the transceiver circuit. The method includes determining the frequency of a channel used by the device using the control circuit and based on the determined signal strength.

According to another embodiment, a method is provided, at a trainable transceiver for controlling a device, for determining a frequency of a channel used by the device. The method includes transmitting a signal with a first frequency to the device using a transceiver circuit. The method includes determining if an acknowledgement signal has been received by the transceiver circuit using a control circuit coupled to the transceiver circuit. The method includes storing the first frequency in memory coupled to the control circuit in response to determining that an acknowledgement signal has been received.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION OF THE PREFERRED EMBODIMENTS

Figure 1:
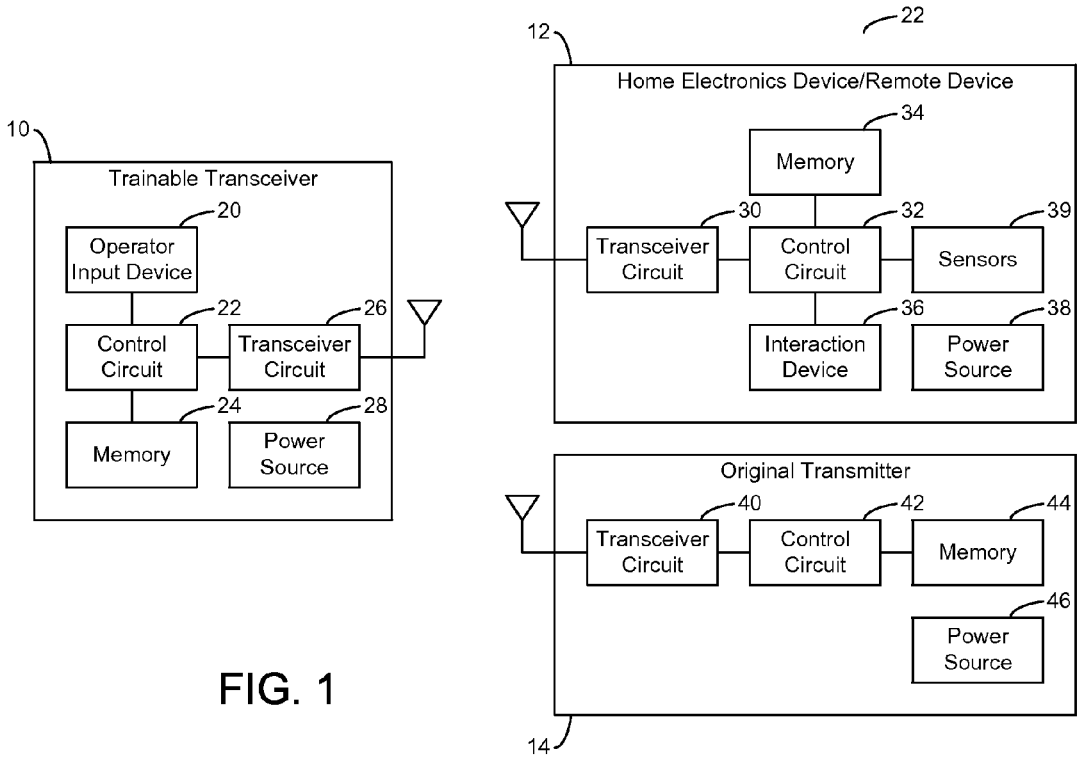
FIG. 1 illustrates hardware components of a trainable transceiver, home electronics device or remote device, and an original transmitter according to an exemplary embodiment.

Generally, a trainable transceiver controls one or more home electronic devices and/or remote devices. For example, the trainable transceiver may be a Homelink™ trainable transceiver. Home electronic devices may include devices such as a garage door opener, gate opener, lights, security system, and/or other device which is configured to receive activation signals and/or control signals. A home electronic device need not be associated with a residence but can also include devices associated with businesses, government buildings or locations, or other fixed locations. Remote devices may include mobile computing devices such as mobile phones, smartphones, tablets, laptops, computing hardware in other vehicles, and/or other devices configured to receive activation signals and/or control signals.

Activation signals may be wired or, preferably, wireless signals transmitted to a home electronic device and/or remote device. Activation signals may include control signals, control data, encryption information (e.g., a rolling code, rolling code seed, look-a-head codes, secret key, fixed code, or other information related to an encryption technique), or other information transmitted to a home electronic device and/or remote device. Activation signals may have parameters such as frequency or frequencies of transmission (e.g., channels), encryption information (e.g., a rolling code, fixed code, or other information related to an encryption technique), identification information (e.g., a serial number, make, model or other information identifying a home electronic device, remote device, and/or other device), and/or other information related to formatting an activation signal to control a particular home electronic device and/or remote device.

In some embodiments, the trainable transceiver receives information from one or more home electronic devices and/or remote devices. The trainable transceiver may receive information using the same transceiver user to send activation signals and/or other information to home electronic devices and/or remote devices. The same wireless transmission scheme, protocol, and/or hardware may be used for transmitting and receiving. The trainable transceiver may have two way communication with home electronic devices and/or remote devices. In other embodiments, the trainable transceiver includes additional hardware for two way communication with devices and/or receiving information from devices. In some embodiments, the trainable transceiver has only one way communication with a home electronic device and/or remote device (e.g., sending activation signals to the device). The trainable transceiver may receive information about the home electronic device and/or remote device using additional hardware. The information about the home electronic device and/or remote device may be received from an intermediary device such as an additional remote device and/or mobile communication device.

A trainable transceiver may also receive information from and/or transmit information to other devices configured to communicate with the trainable transceiver. For example, a trainable transceiver may receive information from cameras (e.g., imaging information may be received) and/or other sensors. The cameras and/or other sensors may communicate with a trainable transceiver wirelessly (e.g., using one or more transceivers) or through a wired connection. In some embodiments, a trainable transceiver may communicate with mobile communications devices (e.g., cell phones, tablets, smartphones, or other communication devices). In some embodiments, mobile communications devices may include other mobile electronics devices such as laptops, personal computers, and/or other devices. In still further embodiments, the trainable transceiver is configured to communicate with networking equipment such as routers, servers, switches, and/or other hardware for enabling network communication. The network may be the internet and/or a cloud architecture.

In some embodiments, the trainable transceiver transmits and/or receives information (e.g., activation signals, control signals, control data, status information, or other information) using a radio frequency signal. For example, the transceiver may transmit and/or receive radio frequency signals in the ultra-high frequency range, typically between 260 and 960 megahertz (MHz) although other frequencies may be used. In other embodiments, a trainable transceiver may include additional hardware for transmitting and/or receiving signals (e.g., activation signals and/or signals for transmitting and/or receiving other information). For example, a trainable transceiver may include a light sensor and/or light emitting element, a microphone and/or speaker, a cellular transceiver, an infrared transceiver, or other communication device.

A trainable transceiver may be configured (e.g., trained) to send activation signals and/or other information to a particular device and/or receive control signals and/or information from a particular device. The trainable transceiver may be trained by a user to work with particular remote devices and/or home electronic devices (e.g., a garage door opener). For example, a user may manually input control information into the trainable transceiver to configure the trainable transceiver to control the device. A trainable transceiver may also learn control information from an original transmitter. A trainable transceiver may receive a signal containing control information from an original transmitter (e.g., a remote sold with a home electronic device) and determine control information from the received signal. Training information (e.g., activation signal frequency, device identification information, encryption information, modulation scheme used by the device, or other information related to controlling a device via an activation signal) may also be received by a trainable transceiver from a remote device, mobile communications device, or other source. In some embodiments, an original transmitter is a transmitter produced by the manufacturer of home electronics device, remote device, or other device for use specifically with the corresponding device. For example, an original transmitter may be a transmitter which is sold separately from a home electronics device, remote device, or other device but is intended to work with that device. The original transmitter may be a transmitter or transceiver that is part of a retrofit kit to add functions to an existing home electronics device, remote device, or other device. An original transmitter may be a transmitter or transceiver that is not manufactured by or under license from the manufacturer or owner of a home electronics device, remote device, or other device.

A trainable transceiver may be mounted or otherwise attached to a vehicle in a variety of locations. For example, a trainable transceiver may be integrated into a dashboard or center stack (e.g., infotainment center) of a vehicle. The trainable transceiver may be integrated into the vehicle by a vehicle manufacturer. A trainable transceiver may be located in other peripheral locations. For example, a trainable transceiver may be removably mounted to a visor. The trainable transceiver may include mounting hardware such as a clip. A trainable transceiver may be mounted to other surfaces of a vehicle (e.g., dashboard, windshield, door panel, or other vehicle component). For example, a trainable transceiver may be secured with adhesive. In some embodiments, a trainable transceiver is integrated in a rear view mirror of the vehicle. A vehicle manufacturer may include a trainable transceiver in the rear view mirror.

In other embodiments, a vehicle may be retrofitted to include a trainable transceiver. This may include attaching a trainable transceiver to a vehicle surface using a clip, adhesive, or other mounting hardware as described above. Alternatively, it may include replacing a vehicle component with one that includes an integrated trainable transceiver and/or installing a vehicle component which includes an integrated trainable transceiver. For example, an aftermarket rear view mirror, vehicle camera system (e.g., one or more cameras and one or more display screens), and/or infotainment center may include an integrated trainable transceiver. In further embodiments, one or more components of a trainable transceiver may be distributed within the vehicle.

Referring now to FIG. 1, an exemplary embodiment of a trainable transceiver 10 is illustrated along with an exemplary embodiment of a home electronics device/remote device 12 and an exemplary embodiment of an original transmitter 14. In one embodiment, the trainable transceiver 10 includes an operator input device 20. The operator input device 20 may be one or more buttons. For example, the operator input device 20 may be three hard key buttons. In some embodiments, the operator input device 20 may include input devices such as touchscreen displays, switches, microphones, knobs, touch sensor (e.g., projected capacitance sensor, resistance based touch sensor, resistive touch sensor, or other touch sensor), proximity sensors (e.g., projected capacitance, infrared, ultrasound, infrared, or other proximity sensor), or other hardware configured to generate an input from a user action. In additional embodiments, the operator input device 20 may display data to a user or other provide outputs. For example, the operator input device 20 may include a display screen (e.g., a display as part of a touchscreen, liquid crystal display, e-ink display, plasma display, light emitting diode (LED) display, or other display device), speaker, haptic feedback device (e.g., vibration motor), LEDs, or other hardware component for providing an output. In some embodiments, the operator input device 20 is connected to a control circuit 22. The control circuit 22 may send information and or control signals or instructions to the operator input device 20. For example, the control circuit 22 may send output instructions to the operator input device 20 causing the display of an image. The control circuit 22 may also receive input signals, instructions, and/or data from the operator input device 20.

The control circuit 22 may include various types of control circuitry, digital and/or analog, and may include a microprocessor, microcontroller, application-specific integrated circuit (ASIC), graphics processing unit (GPU), or other circuitry configured to perform various input/output, control, analysis, and other functions to be described herein. In other embodiments, the control circuit 22 may be a system on a chip (SoC) individually or with additional hardware components described herein. The control circuit 22 may further include, in some embodiments, memory (e.g., random access memory, read only memory, flash memory, hard disk storage, flash memory storage, solid state drive memory, etc.). In further embodiments, the control circuit 22 may function as a controller for one or more hardware components included in the trainable transceiver 10. For example, the control circuit 22 may function as a controller for a touchscreen display or other operator input device 20, a controller for a transceiver, transmitter, receiver, or other communication device (e.g., implement a Bluetooth communications protocol).

In some embodiments, the control circuit 22 receives inputs from operator input devices 20 and processes the inputs. The inputs may be converted into control signals, data, inputs to be sent to a base station, etc. The control circuit 22 may control the transceiver circuit and use the transceiver circuit to communicate (e.g., receive signals and/or transmit signals) with one or more of original transmitters, home electronic devices, mobile communication devices, and/or remote devices. The control circuit 22 may also be used to in the training process.

The control circuit is coupled to memory 24. The memory 24 may be used to facilitate the functions of the trainable transceiver 10 described herein. Memory 24 may be volatile and/or non-volatile memory. For example, memory 24 may be random access memory, read only memory, flash memory, hard disk storage, flash memory storage, solid state drive memory, etc. In some embodiments, the control circuit 22 reads and writes to memory 24. Memory 24 may include computer code modules, data, computer instructions, or other information which may be executed by the control circuit 22 or otherwise facilitate the functions of the trainable transceiver 10 described herein. For example, memory 24 may include encryption codes, pairing information, identification information, a device registry, etc. Memory 24 may include computer instructions, codes, programs, and/or settings which are used to implement the algorithms described herein.

The trainable transceiver 10 may further include a transceiver circuit 26 coupled to the control circuit 22. The transceiver circuit 26 allows the trainable transceiver 10 to transmit and/or receive wireless communication signals. Wireless communication signals may be or include activation signals, control signals, activation signal parameters, status information, notifications, diagnostic information, training information, instructions, and/or other information. The wireless communication signals may be transmitted to or received from a variety of wireless devices (e.g., an original transmitter, home electronic device, mobile communications device, and/or remote device). The transceiver circuit 26 may be controlled by the control circuit 22. For example, the control circuit 22 may turn on or off the transceiver circuit 26, the control circuit 22 may send data using the transceiver circuit 26, format information, an activation signal, control signal, and/or other signal or data for transmission via the transceiver circuit 26, or otherwise control the transceiver circuit 26. Inputs from the transceiver circuit 26 may also be received by the control circuit 22. In some embodiments, the transceiver circuit 26 may include additional hardware such as processors, memory, integrated circuits, antennas, etc. The transceiver circuit 26 may process information prior to transmission or upon reception and prior to passing the information to the control circuit 22. In some embodiments, the transceiver circuit 26 may be coupled directly to memory (e.g., to store encryption data, retrieve encryption data, etc.). In further embodiments, the transceiver circuit 26 may include one or more transceivers, transmitters, receivers, etc. For example, the transceiver circuit 26 may include an optical transceiver, near field communication (NFC) transceiver, etc. In some embodiments, the transceiver circuit 26 may be implemented as a system on a chip. The transceiver circuit 26 may be used to format and/or send activation signals to the device 12 which cause the device 12 to take an action and/or otherwise allows communication with the device 12. The activation signal may include activation signal parameters and/or other information. The transceiver circuit 26 may be or include a radio frequency transceiver (e.g., a transceiver which sends or receives wireless transmission using radio frequency electromagnetic radiation). For example, the transceiver circuit 26 and/or control circuit 22 may modulate radio waves to encode information onto radio frequency electromagnetic radiation produced by the transceiver circuit 26 and/or demodulate radio frequency electromagnetic radiation received by the transceiver circuit 26.

In some embodiments, the transceiver circuit 26 may include additional hardware such as one or more antennas, voltage controlled oscillator circuitry, amplifiers, filters, antenna tuning circuitry, volt meters, and/or other circuitry for the generation of and/or reception of modulated radio waves of different frequencies. The transceiver circuit 26 may provide for the functions described herein using techniques such as modulation, encoding of data onto a carrier wave, decoding data from a modulated carrier wave, signal strength detection, (e.g., computing and/or measuring voltage per length received by an antenna), antenna power regulation, and/or other functions related to the generation of and/or reception of radio waves. For example, the transceiver circuit 26 may be used to generate a carrier wave and encode onto the carrier wave (e.g., through modulation of the carrier wave such as frequency modulation or amplitude modulation) information such as control data, activation signal parameters, an encryption code (e.g., rolling code value), and/or other information. The transceiver circuit 26 may also be used to receive carrier waves and demodulate information contained within the carrier wave. The trainable transceiver 10 may be tuned (e.g., through antenna tuning)

or otherwise controlled to send and/or receive radio waves (e.g., modulated carrier waves) at certain frequencies or channels and/or with a certain bandwidth. The bandwidth may be increased or decreased using hardware and/or software components of the trainable transceiver 10. The frequencies may be selected using hardware and/or software of the trainable transceiver 10. For example, the control circuit, transceiver circuit, and/or memory may be used to implement algorithms, such as the ones described herein as processes or steps, to achieve the functions described herein.

In further embodiments, the control circuit 22 is coupled to additional transceiver circuits, receivers, and/or transmitters. In one embodiment, the transceiver circuit 26 is used for communicating with (transmitting to and/or receiving from) home electronic devices and/or remote devices. In some embodiments, the transceiver circuit 26 may be or include a cellular transceiver. The trainable transceiver may use the transceiver circuit 26 and/or an additional transceiver (e.g., a cellular transceiver) to access the internet, other networks, and/or network hardware. In other embodiments, the trainable transceiver may access the internet, other networks, and/or network hardware through an intermediate device in communication with the trainable transceiver such as a mobile communications device.

Additional transceivers may be used to communicate with other devices (e.g., mobile communications devices, cameras, network devices, or other wireless devices). The transceiver circuit 26 and other transceivers may operate using different frequency, transmission spectrums, protocols, and/or otherwise transmit and/or receive signals using different techniques. For example, the transceiver circuit 26 may be configured to send activation signals to a home electronic device (e.g., a garage door opener) using an encrypted radio wave transmission and an additional transceiver may communicate with a remote communications device (e.g., a smartphone) using a Bluetooth transceiver and Bluetooth communications protocol.

In some embodiments, the trainable transceiver 10 includes a near field communication (NFC) transceiver. The NFC transceiver may be used to communicate with a mobile communications device and/or other device. For example, the NFC transceiver may be used to pair a mobile communications device such as a smartphone and the trainable transceiver. The pairing process may be conducted using NFC. In some embodiments, additional information may be communicated between the trainable transceiver 10 and the mobile communications device and/or other device using NFC.

In some embodiments, the trainable transceiver 10 includes a Bluetooth Low Energy (BLE) transceiver. The BLE transceiver may be a radio frequency transceiver configured to communicate using the Bluetooth Low Energy protocol. In other embodiments, the BLE transceiver may be a radio frequency transceiver configured to communicate using a different protocol, such as a Bluetooth protocol (e.g., v2.0, v3.0, v4.0, etc.). The BLE transceiver may facilitate pairing of the trainable transceiver 10 and a mobile communications device. For example, the trainable transceiver 10 and mobile communications device may establish a communication connection using the BLE transceiver and exchange information relevant to pairing the two devices for further communication using a BLE protocol. Upon pairing (e.g., using the BLE transceiver, NFC transceiver, and/or other techniques), the trainable transceiver 10 may communicate with the mobile communications device using the BLE transceiver.

The trainable transceiver 10 may communicate with original transmitters, home electronic devices, remote devices, mobile communications devices, network devices, and/or other devices as described above using the transceiver circuit 26 and/or other additional transceiver circuits or hardware. The devices with which the trainable transceiver 10 communicates may include transceivers, transmitters, and/or receivers. The communication may be one-way or two-way communication.

The trainable transceiver 10 may include a power source 28. The power source 28 provides electrical power to the components of the trainable transceiver 10. In one embodiment, the power source 28 is self-contained. For example, the power source 28 may be a battery, solar cell, or other power source not requiring a wired connection to another source of electrical power. In other embodiments, the power source 28 may be a wired connection to another power source. For example, the power source 28 may be a wired connection to a vehicle power supply system. The power source 28 may be integrated into the vehicle electrical system. This may allow the trainable transceiver 10 to draw electrical power from a vehicle battery, be turned on or off by a vehicle electrical system (e.g., turned off when the vehicle is turned off, turned on when a vehicle door is opened, etc.), draw power provided by a vehicle alternator, or otherwise be integrated with the electrical power systems(s) of the vehicle.

With continued reference to FIG. 1, the home electronics device or remote device 12 may include hardware components for communication with the trainable transceiver 10 or original transmitter 14. In some embodiments, the home electronics device or remote device 12 includes a transceiver circuit 30. The transceiver circuit 30 may be used to send and/or receive wireless transmissions. For example, the transceiver circuit 30 may be or include a transceiver which sends and/or receives radio frequency electromagnetic signals. The transceiver circuit 30 may allow the home electronics device or remote device 12 to receive an activation signal and/or other transmission from the trainable transceiver 10 or original transmitter 14. For example, the trainable transceiver 10 may transmit an activation signal using activation signal parameters acquired as part of a training process. The home electronics device or remote device 12 may receive the activation signal using the transceiver circuit 30. The transceiver circuit 30 may be configured to transmit signals to the trainable transceiver 10, original transmitter 14, and/or other device. For example, the home electronics device or remote device 12 may transmit status information (e.g., that a garage door is closed) or other information. In some embodiments, the home electronics device or remote device 12 is configured to send and/or receive signals using multiple channels (e.g., a plurality of frequencies of radio waves used for communication). The transceiver circuit 30 of the home electronics device or remote device 12 may function in the same or similar manner as described with reference to the transceiver circuit 26 of the trainable transceiver 10.

The home electronics device or remote device 12 includes memory 34 and/or a control circuit 32 in some embodiments. The memory 34 and/or control circuit 32 may facilitate and/or carry out the functions of the home electronics device or remote device 12 described herein. The control circuit 32 and/or memory 34 may be the same or similar to the control circuit 22 and/or memory 24 described with respect to the trainable transceiver 10. For example, the control circuit 32 may be or include a processor and the memory may be or include volatile (e.g., flash memory)

and/or non-volatile memory (e.g., hard disk storage). The control circuit 32 may carry out computer programs, instructions, and or otherwise use information stored in memory to perform the functions of the home electronics device or remote device. For example, the control circuit 32 and memory 34 may be used to process an activation signal (e.g., perform encryption related tasks such as comparing a received key with a stored key, handling instructions included in the signal, executing instructions, processing information, and/or otherwise manipulating or handling a received signal) received by the transceiver circuit 30 and/or control an interaction device in response to the activation signal.

The home electronics device or remote device 12 may further include an interaction device 36. The interaction device 36 may allow the home electronics device or remote device 12 to interact with another device, component, other hardware, the environment, and/or otherwise allow the home electronics device or remote device 12 to affect itself or something else. The interaction device 36 may be an electrical device such as a light, transceiver, and/or networking hardware. The interaction device 36 may also or alternatively be an electromechanical device such as electric motor, solenoid, or other hardware. The interaction device 36 may be any device capable of having an effect on something. For example, the home electronics device or remote device 12 may be a garage door opener and the interaction device 36 may be a motor. The garage door opener may receive an activation signal using the transceiver circuit 30 which is processed by the control circuit 32 and/or memory 34. The control circuit 32 may then cause the interaction device 36 (e.g., motor) to be activated (e.g., the control circuit 32 may activate a switch which provides electrical power to the motor from a power source). The garage door opener may transmit a signal to the trainable transceiver 10 or original transmitter 14 from which the activation signal originated. The transmission may include information such as receipt of the activation signal, status information about the garage door opener or associated hardware (e.g., the garage door is closed), and/or other information.

The home electronics device or remote device 12 may include a power source 38 for providing electrical power to one or more components of the home electronics device or remote device 12. The power source 38 may be a connection to an external power source, a power source integrated with the device, and/or otherwise be configured to provide electrical power to the device 12. For example, the power source 38 may be a battery, solar cell, or other power source not requiring a wired connection to another source of electrical power. In other embodiments, the power source 38 may be a wired connection to another power source. For example, the power source 38 may be a wired connection to an electrical system of a building, mains power, generator, or other source of electrical power.

In some embodiments, the home electronics device or remote device 12 include one or more sensors 39. Sensors 39 may be used by the device 12 to monitor itself, the environment, hardware controlled by the device 12, and/or otherwise provide information to the device 12. Sensors 39 may provide status information to the device 12. For example, sensors 39 may be or include, temperature sensors (e.g., thermistor, thermocouple, or other hardware for measuring temperature), movement or acceleration sensors (e.g., accelerometers, inclinometers, or other sensors for measuring orientation, movement, or a derivative thereof), safety beams (e.g., sensors which detect when an infrared, or other spectrum, beam of light is broken by an object), sensor which detect distance (e.g., an ultrasound emitter and receiver configured to determine distance of an object), pressure sensors (e.g., pressure transducer, strain gauge, etc.), or other sensor. In some embodiments, one or more sensors 39 are configured to determine the status of a garage door opener or garage door. For example, a pressure sensor may be used to determine if a garage door is closed (e.g., in contact with the ground and/or sensor). Other techniques may be used to determine the status of a garage door opener. The sensor 39 may provide information (e.g., output) to the control circuit 32. The control circuit 32 may process sensor output and/or transmit the processed output and/or raw output using the transceiver circuit 30. For example, processing sensor output may include applying an algorithm or program to the output such as determining whether a garage door is closed based on whether or not the voltage from a pressure sensor exceeds a threshold value.

With continued reference to FIG. 1, components of the original transmitter 14 are illustrated according to an exemplary embodiment. The original transmitter 14 may include a transceiver circuit 40. As described with reference to the trainable transceiver 10, the transceiver circuit 40 of the original transmitter 14 may allow the original transmitter 14 to send transmissions to an associated device (e.g., home electronics device or remote device 12) and/or receive transmissions from an associated device. For example, an original transmitter may send an activation signal to an associated device and/or may receive status information and or other information from the associated device.

The original transmitter 14 may include a control circuit 42 and/or memory 44. The control circuit 42 and/or memory 44 may facilitate the functions of the original transmitter 14 in the same or similar fashion as described with reference to the trainable transceiver 10. For example, the control circuit 42 may receive a user input from an operator input device (e.g., button). The control circuit 42 may cause the transceiver circuit 40 to transmit an activation signal in response. One or more activation signal parameters may be read by the control circuit 42 from memory 44. For example, the memory 44 of the original transmitter 14 may be non-volatile and store activation signal parameters for an associated device such as a frequency used to receive or send transmissions, frequencies used for the same, channels used for the same, encryption information (e.g., rolling code values, a seed value, etc.), device identification information, modulation scheme, and/or other information. In some embodiments, the control circuit 42 may be used to process signals received by the original transmitter 14. For example, the original transmitter 14 may receive a transmission from a device including status information. The control circuit 42 of the original transmitter 14 and/or other hardware may decode the status information. In some embodiments, the original transmitter 14 may provide this information to a user. For example, the original transmitter 14 may illuminate an indicator light in response to particular status information received (e.g., light an indicator light green if a garage door is closed and red if the garage door is open). The original transmitter 14 may further include a power source 46 for providing electrical power to one or more components of the original transmitter. For example, the power source 46 may be a battery.

The transceiver circuit 26 of the trainable transceiver 10 and the transceiver circuit 30 of the home electronics device or remote device 12, the transceiver circuit 40 of the original transmitter 14, and/or transceiver circuit of another device may be configured to communicate, send and/or receive wireless signals (e.g., activation signals, communication signals, and/or other signals). This may allow for communication between the trainable transceiver 10 and other devices. In one embodiment, the transceiver circuits are configured to transmit and/or receive radio frequency transmissions. Communication between the trainable transceiver 10 and other device may be unidirectional or bi-directional. In some embodiments, the trainable transceiver 10 and/or other device may be configured to communicate using multiple frequencies. Each frequency may be a channel used for communication. A home electronics device, remote device, original transmitter, or other device may be configured to communicate using multiple channels for sending and/or receiving radio frequency transmissions using a transceiver circuit. For example, a home electronics device (e.g., garage door opener) may be configured to communicate using multiple channels in the 900 MHz band. Continuing the example, a first channel may be 903.925 MHz and a second channel may be 904.075 MHz. In some embodiments, a single channel is used for transmission and/or reception. In other embodiments, a plurality of channels (e.g., two or more channels) are used for communication by the home electronics device, remote device, original transmitter, and/or other device. For example, a first channel may be used by an original transmitter to send information which is received by the home electronics or remote device and a second channel is used by the home electronic or remote device to send information which is received by the original transmitter. Alternatively, a plurality of channels may be used by the home electronics or remote device for receiving transmissions and a second plurality of channels may be used for transmitting signals with the original transmitter configured to send and receive signals using the respective channels. A home electronics device or remote device and an original transmitter corresponding to the device may be configured to communicate using a plurality of channels.

The trainable transceiver 10 may be trained to use the same plurality of channels thereby allowing the trainable transceiver 10 to communicate with the device 12. The trainable transceiver 10 may be trained (e.g., through a training procedure) to send and/or receive radio frequency transmissions using the channels the device is configured to use for transmitting and/or receiving transmissions. The trainable transceiver 10 may store the channel information and/or other information as activation signal parameters for use with the corresponding device 12. The trainable transceiver 10 may store activation signal parameters (including channel frequencies used by the device) for one or more devices. Using the control circuit 22, memory 24, and/or transceiver circuit 26, the trainable transceiver 10 may format activation signals for a plurality of devices. This allows a single trainable transceiver 10 to control a plurality of devices depending on the user input. For example, the trainable transceiver 10 may receive a first user input and format a first activation signal for the device corresponding to a first device associated with the user input. The first activation signal may include or use a first channel or group of channels associated with the first device. This may allow the first device to communicate with the trainable transceiver 10 using a plurality of channels. Continuing the example, the trainable transceiver 10 may receive a second user input and format a second activation signal for the device corresponding to a second device associated with the user input. The second activation signal may include or use a second channel or group of channels associated with the second device. This may allow the second device to communicate with the trainable transceiver 10 using a plurality of channels.

In some cases, the frequencies actually used by a home electronics device, remote device, original transmitter, or other device do not correspond to frequencies provided by the device manufacturer or other source. The channel frequencies used by a specific home electronics device, remote device, original transmitter, or other device may not match the frequencies used by the device as reported in the specification corresponding to the device. For example, one garage door opener of a specific make and model may have channel frequencies which are offset from the channel frequencies reported in the specification for all devices of that make and model by a certain frequency. For example, all garage door openers of a certain make and model may have an actual channel frequency which is offset as much as 78 KHz from the channel frequency reported in the specification. Continuing the example, a first frequency (e.g., channel with offset) used by the device may be 900.078 MHz while the channel frequency reported in the specification is 900.000 MHz. A second frequency (e.g., second channel) used by the device may be 901.078 MHz while the second channel frequency reported in the specification is 901.000 MHz.

In some cases, the offset between the actual frequency of one channel and the reported frequency (e.g., in the specification) may be the same offset between the actual frequency and reported frequency of all channels used by the device. For example, each channel actually used by the device may be at a frequency which is 78 KHz greater than the channel frequency reported in the specification of the device. In other words, the frequency offset may be consistent from channel to channel for a given home electronics device, remote device, original transmitter, or other device. In other cases, the frequency offset may differ from channel to channel.

In some cases where the channel offset is consistent from channel to channel for a given device (e.g., a garage door opener), the amount of the frequency offset may differ between home electronics device, remote devices, original transmitter, or other devices of the same make and model. For example, a first garage door opener may have a frequency offset of 76 KHz consistent from channel to channel, and a second garage door opener of the same make and model as the first garage door opener may have a frequency offset of 78 KHz consistent from channel to channel. Frequency offsets may be caused by variations between oscillators used in home electronics device, remote devices, original transmitter, or other devices having the same make and model. Frequency offsets may have other causes (e.g., manufacturing defects, incorrect information being provided in the specification, variance of devices within part tolerances, etc.). Frequency offsets may cause difficulties for or prevent a trainable transceiver from communicating with a home electronics device, remote device, original transmitter, or other device via unidirectional and/or bi-directional communication.

The process of training the trainable transceiver 10 may include the trainable transceiver 10 acquiring or using a frequency or frequencies obtained from the specification or manufacturer of a home electronics device, remote device, original transmitter, or other device. For example, the trainable transceiver 10 may read from memory stored frequencies or channels corresponding to a device identified through user input as the device for which the trainable transceiver 10 is being trained to control. The frequencies may be stored in the memory of the trainable transceiver during the manufacture of the trainable transceiver. The manufacturer may acquire the frequencies from the manufacturer of the device or an available specification for the device. Alternative techniques for providing the frequency, frequencies, or channels corresponding with a device to the trainable transceiver 10 may be used. The frequency, frequencies, or channels provided to the trainable transceiver 10 may come from a database, specification, device manufacturer, or other source, and the frequency, frequencies, or channels provided to the trainable transceiver 10 may not match or correspond with the frequency, frequencies, or channels actually used by the device.

As the frequency, frequencies, or channels actually used by the device may not match the frequencies of the device acquired by the trainable transceiver 10 during a training process, the trainable transceiver 10 may not be able to control or otherwise communicate with the device following the training process.

In some embodiments, the trainable transceiver 10 may automatically adjust activation signal parameters (e.g., the frequency, frequencies, or channels used in communication with the device) associated with a device to compensate for the frequency, frequencies, or channels being different from those listed in the specification of the device. Advantageously, this may allow for the trainable transceiver 10 to be trained to control a device which uses frequencies that differ from those listed in the specification of the device. If the frequencies of the device listed in the specification were relied upon in training the trainable transceiver 10, the trainable transceiver 10 may not be able to communicate with the device without using one or more of the techniques described herein. Thus, the trainable transceiver 10 as described herein provides an advantage in that it allows the trainable transceiver 10 to be trained to control a device for which the training information (e.g., frequency, frequencies, or channel listed in the specification of the device) do not correspond (e.g., match) with the frequency, frequencies, or channels actually used by the device.

The trainable transceiver 10 may be trained to an existing original transmitter 14 such that the trainable transceiver 10 may control the device 12 associated with the original transmitter 14. For example, a user may place the trainable transceiver 10 and original transmitter 14 such that the trainable transceiver 10 is within the transmission range of the original transmitter 14. The user may then cause the original transmitter 14 to send an activation signal or other transmission (e.g., by depressing a button on the original transmitter 14). The trainable transceiver 10 may identify one or more activation signal parameters, the device, and/or other information based on the transmission from the original transmitter 14 which the trainable transceiver 10 may receive using the transceiver circuit 26. The control circuit 22, memory 24, and/or other transceiver circuit may identify, determine, and or store information such as the frequency, frequencies, or channels used by the original transmitter 14 and therefore the device 12 associated with the original transmitter 14, a control code or other encryption information, carrier frequency, bandwidth, and or other information.

In some embodiments, the home electronics device, remote device, or other device may be configured to learn an identifier, encryption information, and/or other information from a trainable transceiver. For example, the device 12 may be placed in a learning mode during which time a user sends a transmission from the trainable transceiver 10 (e.g., by providing an input causing the transmission). The device 12 may receive the transmission and perform a function in response. For example, the device 12 may send an acknowledgement transmission in response to receiving the transmission, send a transmission including a ready indication (e.g., that the device 12 is synchronized with the trainable transceiver 10, encryption information has been exchanged, communication has been acknowledged on all channels used by the device 12, etc.), store an identifier of the trainable transceiver 10, and/or perform other functions. This may process may constitute a pairing of the trainable transceiver 10 and the home electronics device, remote device, or other device. For systems using a rolling code, the trainable transceiver 10 and device 12 may be synchronized so that the counters of the trainable transceiver 10 and the device 12 begin with the same rolling code value.

The trainable transceiver may pair with a home electronics device, remote device, original transmitter, and/or other device and analyze the signal from the device to determine a frequency offset and apply that offset to itself. The trainable transceiver may also receive a transmission from an original transmitter without pairing with the original transmitter. In embodiments where the frequency offset is consistent from channel to channel, the trainable transceiver may determine the offset for one channel and apply that offset to every channel used by the trainable transceiver and/or device. The trainable transceiver may determine the offset by scanning a region of multiple frequencies and measuring the peak signal strength of each frequency. The frequency with the highest signal strength may be identified as the channel frequency actually used by the device. In alternative embodiments, the channel frequency actually used by the device is determined by sending a transmission and listening for a response from the device over a plurality of transmission frequencies as described later herein and with reference to FIG. 3. The trainable transceiver may then determine the difference between this actual measured frequency for the channel and a frequency for the channel corresponding to the device specification (e.g., the channel frequency acquired during training of the trainable transceiver or otherwise acquired). This determined difference (e.g., offset) may be used to adjust all channels used by the trainable transceiver and/or device. For example, if it is determined that the measured channel has a frequency of 900.025 MHz and the expected channel frequency (e.g., channel frequency in the specification and/or acquired during training) is 900.000 MHz, the trainable transceiver may adjust each channel frequency by increasing each channel frequency by 25 KHz.

As explained above, the amount of frequency offset may vary from device to device even if both devices are the same make and model. In order to determine the appropriate frequency offset to apply in order to allow for communication or improved communication with a new device, the trainable transceiver may determine the frequency offset using one or more techniques described herein each time the trainable transceiver is paired with a device with which it has not been previously paired (e.g., a new device). For example, a trainable transceiver may pair with a first garage door opener with which the trainable transceiver has not previously been paired. The trainable transceiver may use one or more techniques described herein to determine the frequency offset of the first garage door opener. The trainable transceiver may pair with a second garage door opener with which the trainable transceiver has not been previously paired. Even if the first garage door opener and the second garage door opener are the same make and model, the frequency offsets of the first and second garage door openers may be different. Therefore, the trainable transceiver may determine the frequency offset of the second garage door opener using one or more of the techniques described herein.

Figure 2A:
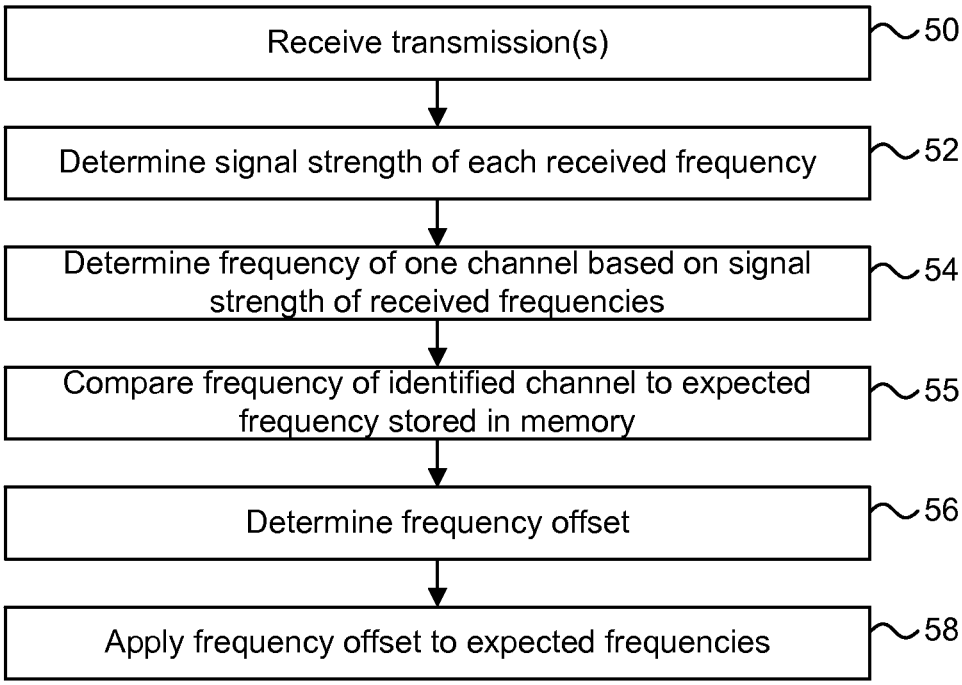
FIG. 2A illustrates a flow chart for identifying and applying a channel frequency offset for a device based on signal strength and using a trainable transceiver according to an exemplary embodiment.

In one embodiment, the trainable transceiver automatically adjusts for the difference between the reported frequency or frequencies used by the device and the actual frequency or frequencies used by the device (e.g., frequency offset or channel offset) using the signal strength of a transmission or transmission from the device. Referring now to FIG. 2A, a trainable transceiver may determine a frequency offset and adjust the channel frequency it uses by first receiving a transmission (step 50). In one embodiment, the transmission is sent from a home electronics device or remote. The transmission may be sent as part of pairing the trainable transceiver to the home electronics device or remote device. For example, the transmission may be sent in response to the device being placed in a learning mode by a user and/or receiving a transmission from the trainable transceiver while in learning mode. This may be part of a process to synchronize a trainable transceiver and device (e.g., to exchange encryption information). For example, the transmission from the device may be an acknowledgement signal. In other embodiments, the transmission received by the trainable transceiver is from an original transmitter. For example, the trainable transceiver may be placed into a learning mode, and a user may send an activation signal from an original transmitter by providing the original transmitter with a user input (e.g., depressing a button on the original transmitter).

Using the received signal or signals (e.g., one or more transmissions on the same or different channels), the trainable transceiver may determine the signal strength of the transmission received for a plurality of frequencies (step 52). For example, the trainable transceiver may use the transceiver circuit and the hardware components included therein along with the control circuit to apply an algorithm for determining the signal strength of the signal received at a plurality of frequencies. The transceiver circuit may sweep through a plurality of frequencies measuring the strength of the signal received at each frequency. For example, the antenna may be tuned to a plurality of frequencies during the reception of the transmission or signal from the device or original transmitter. As the antenna is tuned and/or the transceiver circuit is otherwise configured to receive a carrier wave at a specific frequency (e.g., a particular channel), the trainable transceiver may determine the signal strength of the signal at that particular frequency or channel. Thus, the signal strength may be measured or otherwise determined at a plurality of frequencies. In some embodiments, the trainable transceiver (e.g., using the control circuit and transceiver circuit) may increase, decrease, or otherwise alter the bandwidth of the channel for which the signal strength is being determined. The trainable transceiver may shift the frequency for which signal strength is being measured and increase or decrease the bandwidth of the channel for which signal strength is being measured. Advantageously, this may allow the trainable transceiver to determine the signal strength coarsely and then finely by first using a large bandwidth and then a smaller bandwidth. Altering the bandwidth may also allow the trainable transceiver to determine the signal strength with respect to a fewer number of channels (e.g., by using a larger bandwidth). This may provide an advantage in that the time required to determine the signal strength for a transmission may be reduced as the signal strength may be measured for fewer channels while still covering the same range of frequencies.

In some embodiments, the frequencies for which the signal strength is measured may be determined based on a frequency, frequencies, or channels which the trainable transceiver has previously acquired and stored for the device (e.g., frequencies acquired during training) For example, the trainable transceiver may have stored a particular frequency or channel as corresponding to the device. The frequency or channel may have been provided by a manufacturer or specification for the device. Using this frequency or channel as a starting point, the trainable transceiver may measure signal strength at frequencies surrounding the expected frequency for the transmission from the device based on the specification. Advantageously, this may reduce the number of frequencies for which the signal strength is determined. This may reduce the time needed to identify the channel frequency actually used by decreasing the amount of time required for measuring the signal strength of frequencies near the expected frequency. For example, the expected frequency for one channel of the device may be 900.000 MHz. The trainable transceiver may be programmed with expected maximum frequency offset for a particular device (e.g., 78 KHz for this device). Therefore, the trainable transceiver may measure the signal strength at frequencies falling within the range of 899.922 MHz to 900.078 MHz. The signal strength of multiple frequencies may be determined for a single channel (e.g., by determining the signal strength of frequencies in a range about one expected channel used by a device having multiple channels).

After determining the signal strength for a plurality of channels, the trainable transceiver may determine the frequency of a channel actually used by the device based on the signal strength of the frequencies received (step 54). This may include applying an algorithm to the signal strength determined for each frequency in the previous step. For example, the frequencies and associated signal strengths may be stored in memory of the trainable transceiver as an array. The trainable transceiver may apply an algorithm or algorithms to determine the channel frequency actually used by the device. For example, the trainable transceiver may search the array to find the highest signal strength value. The associated frequency may be determined to be the frequency of the channel actually used by the device. Frequencies with a signal strength value below a certain threshold may be disregarded as noise (e.g., no signal or transmission from the device was made using the frequency). Other algorithms may be used in place of or in addition to the examples provided in order to determine the frequency actually used by the device. For example, the trainable transceiver may use interpolation between two or more signal strength values, curve fitting, and/or other prediction techniques or other techniques to determine the frequency of the channel used by the device if the frequency with the largest signal strength was not directly measured during previous steps.

After determining the frequency actually used by the device, the trainable transceiver may compare the identified channel frequency (e.g., the channel frequency actually used by the device) to the expected frequency for the channel stored in memory (e.g., the channel frequency provided by training, the manufacturer, the specification of the device, and/or other source) (step 55). For example, the trainable transceiver (e.g., using the control circuit and memory) may take the difference between the identified channel frequency and the expected channel frequency.

Based on the comparison between the frequency of the identified channel to the expected frequency, the trainable transceiver may determine the frequency offset (step 56). For example, the frequency offset may be the difference between the two values determined in the comparison step. Determining the frequency offset may include determining the magnitude of the frequency offset and the direction in which the offset is to be applied in order to correct for the frequency offset. For example, the difference of the identified and expected values may be used to determine the magnitude of the frequency offset (e.g., absolute value) and the sign of the resulting difference may be used to determine whether to add the magnitude of the offset or subtract the magnitude of the offset to the stored frequency values in order to compensate for the frequency offset.

After determining the frequency offset, the trainable transceiver may apply the frequency offset to the expected channel frequencies (step 58). In cases where the device only uses a single channel or frequency, the determined frequency may be stored as the channel frequency to be used in communication with the device and the comparison step and determination of the frequency offset step may be omitted. The determined frequency may be stored with an identifier of the device such that the trainable transceiver may determine which frequency to use for each device for which the trainable transceiver is trained to control or otherwise communicate with.

In cases where the device uses a plurality of channels, the frequency offset may be applied to the expected frequency values previously stored in memory. For example, the trainable transceiver may have previously stored or otherwise have in memory expected frequency values corresponding to each channel used by the device (e.g., the values may have been stored in memory during manufacture of the trainable transceiver and be based on the specification of the device). The trainable transceiver may apply the frequency offset determine for one channel to all the expected channel frequency values stored in memory. The new channel frequency values may be stored in memory as corresponding to identification information for the particular device. The expected channel frequency values may remain stored in memory (e.g., not overwritten by the frequency values modified by the frequency offset). Advantageously, this may allow the trainable transceiver to use the process described above for an additional device of the same make and model but which may have a different frequency offset. In some embodiments, storing the determined channel frequency values occurs simultaneously with applying the frequency offset to each channel. For example, each value may be stored after the frequency offset is applied and prior to applying the frequency offset to the next expected value.

Figure 2B:
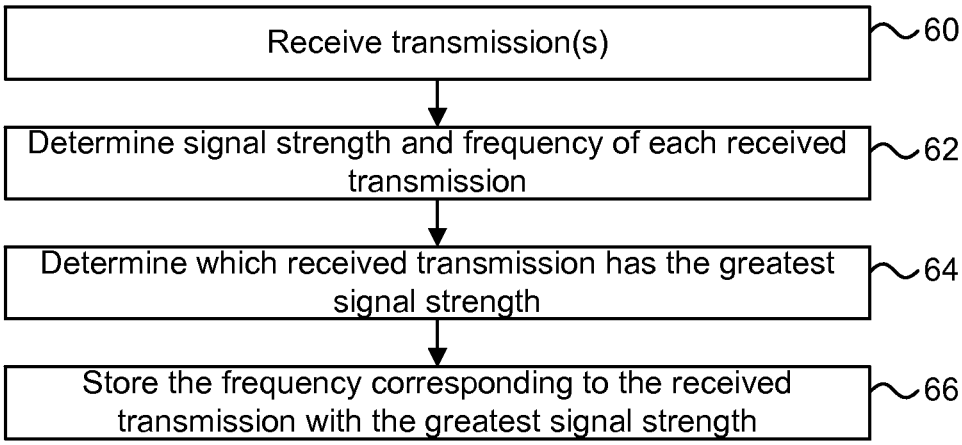
FIG. 2B illustrates a flow chart for identifying the channel(s) of a device based on signal strength using a trainable transceiver according to an exemplary embodiment.

Referring now to FIG. 2B, the same techniques described above with reference to FIG. 2A may be used to identify all the channels used by a device rather than identifying a single channel determining the frequency offset and applying the frequency offset to the remaining channels. This technique can be used when a channel frequency offset is not consistent across all devices of a particular make and model. In the case that the channel frequency offset is consistent across all devices of one make and model, the technique previously described with reference to FIG. 2A can be used. In alternative embodiments, the technique described herein with reference to FIG. 2B can be used even when the channel frequency offset is consistent across all devices of a single make and model.

The trainable transceiver may determine the frequency of a channel used by the remote device or original transmitter based on the signal strength of one or more received transmissions. The trainable transceiver may be tuned to receive a signal for one of a plurality of frequencies. A user and/or the trainable transceiver can cause a transmission by the remote device or the original transmitter. The trainable transceiver can then receive the transmission (step 60). This may be repeated for a plurality of frequencies. Instead of receiving transmission at frequencies near a single channel, the antenna and/or transceiver circuit may be controlled such that transmissions are received for frequencies near all the expected channels of the device. Alternatively, the transceiver circuit may be controlled to listen for or attempt to receive transmissions for a plurality of frequencies within a band of frequencies used by the device or class of device. For example, the trainable transceiver may attempt to receive transmissions on a plurality of frequencies (e.g., every 25 KHz) within a range of frequencies used by a particular device (e.g., a garage door opener using the 900 MHz band). The single strength of each frequency may be measured as discussed above. Similarly, the bandwidth may be adjusted as described above. After receiving the transmission(s), the trainable transceiver may determine the signal strength corresponding to each frequency (step 62). For example, the trainable transceiver may store in memory the frequency for which it was tuned to receive transmissions. The trainable transceiver may also store in memory the signal strength of a signals received corresponding to that frequency. Signal strength may be measured based on the voltage measured at an antenna and the geometry of the antenna. The trainable transceiver may compare the stored signal strengths and determine the greatest signal strength (step 64).

The trainable transceiver may then determine the actual channels used by the device or original transmitter using the techniques discussed with reference to FIG. 2A. Rather than determine the frequency of a single channel, the trainable transceiver may apply one or more of the above discussed techniques to determine the actual frequency of every channel used by the device. For example, the trainable transceiver (e.g., using the control circuit, memory, algorithms, and/or other hardware or software), may identify channels as peaks in signal strength. The trainable transceiver may identify a channel as a frequency having a signal strength above a threshold value. Every time a frequency is identified with a signal strength above the threshold value, the frequency may be stored as an actual channel. In some embodiments, the expected channel frequency values are used to identify the actual channel frequency values for all channels using the techniques described above with reference to FIG. 2A. For example, the expected channel frequency value may be used along with the maximum expected frequency offset to define a search range of frequencies for each channel. Other techniques may be used to define the search range. The frequency with the largest signal strength in the search range may be stored as the actual frequency corresponding to the channel. This process may be repeated for each expected channel value in order to determine and store the actual channel value for each channel of the device. Other techniques may be used to determine the actual frequency of each channel of the device. The bandwidth may be adjusted or otherwise used in determining the channels as described above with respect to FIG. 2A.

After determining the actual channel frequencies, and upon determining the greatest signal strength stored in memory, the trainable transceiver may store the corresponding frequency in memory as the frequency of the channel used by the remote device and/or original transmitter (step 66). This frequency may be used by the trainable transceiver to communicate with the remote device. Alternatively, the trainable transceiver may store all the frequencies for which the corresponding signal strength exceeds a predetermine signal strength. Thus, the trainable transceiver can identify a plurality of channels used by a remote device based on the signal strength for a plurality of transmissions received. The actual channel frequencies may be stored in memory corresponding to device identification information such that the trainable transceiver may use the channel values for the particular device for which they were determined. The expected channel values may be retained in memory. In some embodiments, storing the determined channel frequency values occurs simultaneously with determining the actual channel values. For example, each value may be stored as it is determined.

In one embodiment, the trainable transceiver automatically adjusts for the difference between the reported frequency or frequencies used by the device and the actual frequency or frequencies used by the device (e.g., frequency offset or channel offset) by transmitting on a plurality of frequencies and determining whether an acknowledgement signal corresponding to the transmission from the trainable transceiver has been received for each frequency. The trainable transceiver may transmit on a range of frequencies. If an acknowledgement message is received from the device in response to the transmission on the particular frequency, the trainable transceiver may determine that the frequency is used by the device. If no acknowledgement message is received, the trainable transceiver may determine that the frequency is not used by the device. The trainable transceiver may determine which frequencies work with the device and which frequencies don't work with the device and choose the best case frequencies to use with the device.

Figure 3A:
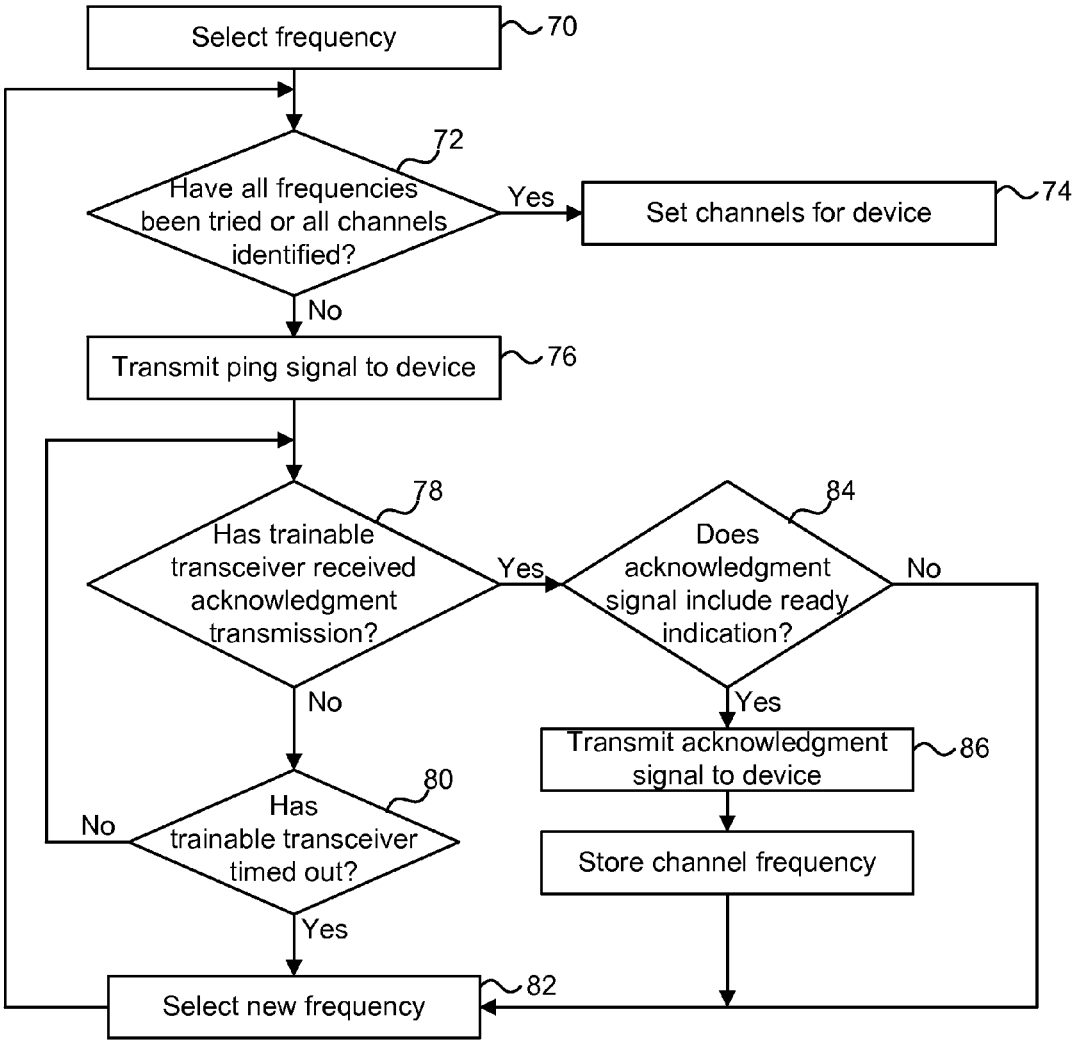
FIG. 3A illustrates a flow chart for identifying a frequency offset based on transmissions to a device and received acknowledgement signals from the device according to an exemplary embodiment.

Referring now to FIG. 3A, a flow chart illustrates an exemplary embodiment of the logic (e.g., algorithm) for determining which channel frequencies are used by a device based on transmissions and acknowledgement signals (e.g., messages encoded on a signal received by the trainable transceiver and sent from the device in response to a transmission from the trainable transceiver). The determination of the frequencies actually used by the device may be made during a pairing process in which the trainable transceiver and the device are paired. This method uses bi-directional communication between the trainable transceiver and the home electronics device, remote device, or other device. Bi-directional communication may be established by pairing the device and the trainable transceiver and/or using the techniques described herein. The trainable transceiver may select a first frequency for which to transmit a signal to the home electronics device, remote device, or other device (step 70). The first frequency may be selected based on an expected value of the frequency (e.g., channel) used by the device. The expected value may be the value provided by the manufacture or specification of the device. The trainable transceiver may access the expected value from memory (e.g., the expected value(s) for a plurality of makes and models are stored in memory of the trainable transceiver during manufacture of the trainable transceiver). The first frequency may be selected based on information provided to the trainable transceiver during a pairing process with a device. For example, the device may provide information to the trainable transceiver in a transmission such as the frequencies on which the device is transmitting and receiving (e.g., the device may have hardware which can perform diagnostic or other functions for determining the frequencies or channels actually used by the device). The frequency used by the device to transmit information during a pairing process may be used as the first frequency. Other techniques may be used to select the first frequency.

The trainable transceiver may then determine if all the transmission frequencies have been used to transmit and check for an acknowledgement signal from the device (step 72). As a frequency is used to transmit to the device and determine if an acknowledgement signal is received, the frequency may be flagged by the trainable transceiver. Alternatively, the trainable transceiver may systematically use frequencies in a list, array, or other data structure until the last frequency is used. The values of all frequencies to try may be determined based on factors such as the expected frequency values for each channel (e.g., frequencies from the device specification), the maximum expected frequency offset value, the bandwidth of the transmissions to the device, and/or other factors. For example, the list of all frequencies to try may be made up of the expected frequency value of each channel used by the device and corresponding frequency values determined using the maximum expected frequency offset for the device and the bandwidth to be used. Continuing the example, the expected channel value may be 904.000 MHz, with an expected maximum frequency offset for the device of 75 KHz. The step size chosen for identifying the channel frequency may be 25 KHz. This results in a plurality of transmission frequencies for use in identifying the frequency used by the channel (e.g., the list of all frequency values for transmission) being 903.925 MHz, 903.950 MHz, 903.975 MHz, 904.000 MHz, 904.025 MHz, 904.050 MHz, and 904.075 MHz. For each transmission frequency, a transmission is sent and the trainable transceiver listens for a reply. Once a reply is received, the trainable transceiver may stop sending transmissions. In some embodiments, the trainable transceiver may use an increased step size to reduce the number of frequencies for which transmissions are sent to the device and acknowledgement signals are detected. In alternative embodiments, the step size is decreased.

Figure 3B:
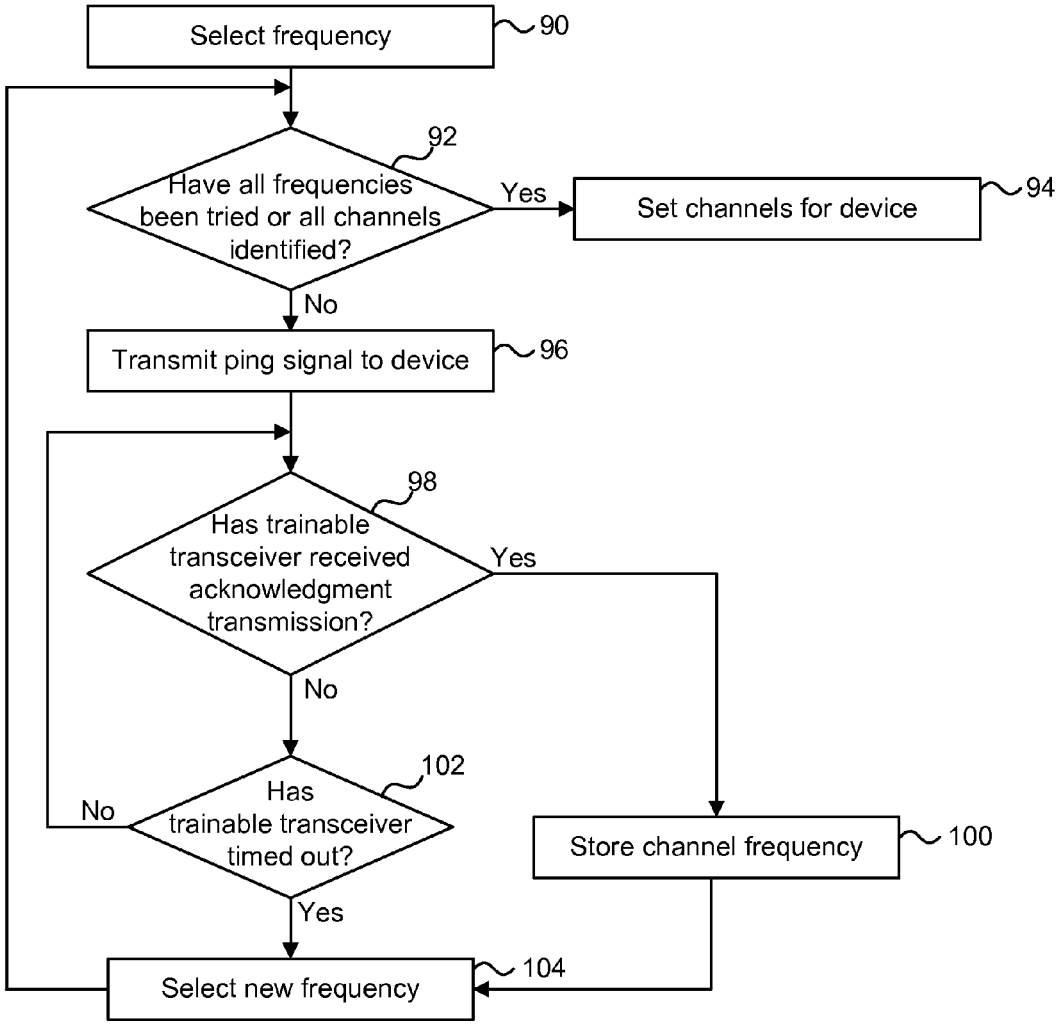
FIG. 3B illustrates a flow chart for identifying a frequency offset based on transmissions to a device and received acknowledgement signals, without analyzing the content of the acknowledgment signals, according to an exemplary embodiment.

Alternatively or additionally, the trainable transceiver may determine if all channels used by the device have been identified. For example, the trainable transceiver may determine that all channels used by the device have not been identified if the trainable transceiver has not received an acknowledgement signal from the device including a ready indication. The trainable transceiver may determine that all channels used by the device have been identified if the trainable transceiver has received an acknowledgement signal from the device including a ready indication. In some embodiments and as illustrated in FIG. 3B, the trainable transceiver does not determine if the acknowledgement signal includes a ready indication. Rather, if an acknowledgment signal is received, the corresponding frequency (e.g., the frequency of the transmission) is stored.

Still referring to FIG. 3A, the trainable transceiver may alternatively determine if all channels have been identified if the number of channels identified is equal to the number of expected channels. The number of expected channels may be a value stored in memory are determined from the expected channel values stored in memory of the trainable transceiver (e.g., during manufacture of the trainable transceiver and based on the specification of the device, acquired during training, or otherwise stored in memory of the trainable transceiver).

If the trainable transceiver determines (e.g., using the control circuit, memory, algorithm, software, and/or other hardware and software) that all frequencies have been tried and/or that all channels have been identified, the trainable transceiver may set the channels for the device (step 74). This may include storing all channel frequencies identified using the process described herein in memory along with a device identifier (e.g., device identification information). Expected channel values may be retained.

If the trainable transceiver determines that all frequencies have not been tried and/or that all channels have not been identified, the trainable transceiver may transmit a ping signal to the device (step 76). The ping signal is based on the current value of the frequency (e.g., the frequency for which an acknowledgement signal is to be detected or not detected in response to the transmission using the frequency). For example, during the first iteration, the ping transmission is a transmission made using the first selected frequency. During subsequent iterations, the frequency value is a newly selected frequency as discussed herein. The ping signal may be formatted by the control circuit and/or transceiver circuit to be transmitted on the frequency being tested for an acknowledgement response by the device. The ping signal may include information, a message, instruction, or other data which if received by the device (e.g., it is transmitted using a frequency the device is capable of receiving and within range of the device), causes the device to transmit an acknowledgement signal (either broadly or to the trainable transceiver).

The trainable transceiver may then determine if an acknowledgement transmission or signal has been received from the device (step 78). If the device receives the ping signal, the device will transmit an acknowledgment signal as described above. The trainable transceiver may receive the acknowledgement signal using the transceiver circuit. The trainable transceiver may be configured to attempt to receive an acknowledgement signal on the same frequency used to transmit the ping signal, a different frequency than was used to transmit the ping signal, and/or multiple frequencies (e.g., all frequencies in a band used by the device). An acknowledgement signal may be received by the transceiver circuit. The transceiver circuit may demodulate the signal received and pass information to the control circuit. The control circuit and/or memory (e.g., a program or algorithm stored in memory) may be used to determine if a received signal is an acknowledgment signal.

If the trainable transceiver determines (e.g., using a control circuit and/or memory) that an acknowledgement signal has not been received, the trainable transceiver may determine if the trainable transceiver has timed out (step 80). For example, the control circuit and/or memory may be used to determine if a set amount of time (e.g., 3 seconds) has passed since the ping signal was transmitted. If the set amount of time has not passed, the trainable transceiver may determine if an acknowledgement signal has been received again. These two steps may continue in a loop until either the trainable transceiver determines that an acknowledgement signal has been received or the trainable transceiver has timed out (e.g., the amount of time since the ping signal was transmitted exceeds the set amount of time). In some embodiments, a delay may be included in the loop such that the trainable transceiver waits a set amount of time (e.g., 20 milliseconds) following a determination that the trainable transceiver has not timed out prior to checking again if an acknowledgement signal or transmission has been received. If the trainable transceiver determines that it has time out, the trainable transceiver may select a new frequency as discussed in further detail herein (step 82). In other embodiments, the trainable transceiver may determine if the device has timed out rather than the trainable transceiver.

Referring again to the previous step, if the trainable transceiver determines that an acknowledgment signal has been received, the trainable transceiver may then determine if the acknowledgment signal includes a ready indication (step 84). The control circuit and/or memory of the trainable transceiver (e.g., using an algorithm, computer program, or other software or hardware) may determine if the content of the acknowledgement signal from the device includes information or data corresponding to a ready indication. For example, the payload of a packet, header of a packet, or other portion of a packet contained in the acknowledgement signal received and demodulated by the transceiver circuit may a ready indication or ready message. In some embodiments, determining if the acknowledgement signal includes a ready indication may include decrypting the signal received from the device or other encryption techniques. The ready indication may indicate that the device uses the channel frequency for communication with trainable transceivers and/or original transmitters and/or that communication has been successfully established using the frequency of the ping signal. If the acknowledgement signal does not include a ready indication, this may indicate that the device uses the channel but not for communication with a trainable transceiver and/or original transmitter and/or that communication has not been successfully established using the frequency of the ping signal. Therefore, the channel frequency of an acknowledgement signal not including a ready indication may be discarded (e.g., not stored in memory). In other embodiments, frequencies used in transmitting a ping signal which results in an acknowledgement signal are stored as a channel frequency (e.g., the store channel frequency step may be performed following the determination that an acknowledgement signal has been received). The ready indication may be included in an acknowledgement signal by a device in response to the device receiving a ping signal on every channel used by the device. The ready indication may indicate that the device has established (e.g., acknowledged) communication with the trainable transceiver on all channels used by the device. As later explained in more detail with reference to FIG. 3B, the trainable transceiver does not determine if the acknowledgement signal includes a ready indication in some embodiments. Rather, the trainable transceiver stores the transmission frequency as the channel frequency without determining the content of the acknowledgement signal.

If the trainable transceiver determines that the acknowledgment signal does not include a ready indication, the trainable transceiver may select a new frequency as discussed herein (step 82). If the trainable transceiver determines that the acknowledgment signal does include a ready indication, the trainable transceiver may transmit an acknowledgement signal to the device.

The trainable transceiver may transmit an acknowledgement signal to the device using the transceiver circuit (step 86). This acknowledgement signal may be or include information, instructions, or other data which suppresses re-tries from the device or otherwise suppresses re-tries from the device when received by the device. In other words, when the device receives an acknowledgement signal from the trainable transceiver, the device may cease sending acknowledgement signals in response to a received pin signal from the trainable transceiver. The acknowledgement signal sent by the trainable transceiver to the device may indicate that the communication has been successfully established using the frequency of the ping signal.

After transmitting the acknowledgement signal to the device, the trainable transceiver may store the channel frequency (step 88). For example, the control circuit may store the frequency used when transmitting the ping signal (e.g., the current frequency value) in memory of the trainable transceiver. The channel frequency may be stored as a frequency which is used for communication with the particular device. The channel frequency may be stored with or referencing device identification information for the device.

After storing the channel frequency or in response to another determination (e.g., that the trainable transceiver has timed out or that the acknowledgement signal from the device does not include a ready indication), the trainable transceiver may select a new frequency (step 82). The new frequency may be selected with a technique described with reference to selecting the first frequency. For example, the new frequency may be the next frequency in a list or other data structure for determination if the frequency is used by the device. The list or data structure may be generated as previously described (e.g., using the expected values of the channel frequencies). Upon selecting a new frequency, the old frequency may be flagged as analyzed such that it is ineligible for being selected as new frequency in a subsequent iteration of the process described herein. If all the frequencies have been previously selected, the trainable transceiver may set a variable value indicating as such or set the frequency value to a value which indicates that all frequencies have been previously analyzed. The trainable transceiver may determine that all frequencies have been tried in response to determining that this variable value and/or frequency value is the current value. After selecting a new frequency, the process may go through another iteration. The iterations may be used to identify all the channels (and the corresponding frequencies) used by the device. Advantageously, this may identify all channels used by the device in cases where the frequency offset of the device is not uniform for all channels used by the device.

In other embodiments, the above described process is used to determine the frequency of a single channel used by the device. Multiple frequencies may be checked for an acknowledgement signal and/or ready indication from the device. If received, the frequency used in the ping transmission which resulted in the response from the device may be stored as the actual channel frequency of the device. Using the actual channel frequency of the device and the expected channel frequency of the device, the trainable transceiver may determine the frequency offset of the device. The frequency offset of the device may be used to adjust each expected frequency for the device. Advantageously, this may allow the trainable transceiver to identify a single channel and modify all other channels accordingly. This may decrease the time it takes for a trainable transceiver to adjust for a frequency offset of a device. This may also allow a trainable transceiver to better determine the frequency or frequencies used by the device as more iterations may be used to determine the frequency of one channel in the same time that would be required to determine the frequencies of all channels used by the device. A smaller bandwidth may be used in determining a single channel than in determining multiple channels.

In some embodiments, the trainable transceiver may prompt a user if no channel frequency is identified (e.g., the trainable transceiver receives no acknowledgement responses and/or ready indications from the device). For example, the prompt may be the illumination of a light source included in the trainable transceiver. In some embodiments, the trainable transceiver may increase its transmission bandwidth in addition to or instead of providing the user with a prompt. The increased bandwidth may allow the trainable transceiver to communicate with the device despite being unable to identify a channel frequency. For example, an expected channel frequency value may be used for transmission by the trainable transceiver with the bandwidth increased to include the expected frequency offset for the device. Alternatively, the bandwidth may be increased or decreased and the process described above repeated until a channel is identified.

Referring now to FIG. 3B, a flow chart is illustrated for identifying a frequency offset based on transmissions to a device and received acknowledgement signals, without analyzing the acknowledgment signals, according to one embodiment. As explained above, the trainable transceiver can determine the frequency used by a remote device based on receiving an acknowledgement signal without determining the content of the acknowledgement signal. The trainable transceiver can select a frequency (step 90). The trainable transceiver may then determine if all the transmission frequencies have been used to transmit and check for an acknowledgement signal from the device (step 92). If all frequencies have been tried, the trainable transceiver sets the channel frequencies for the remote device based on the channel frequencies stored in memory (step 94). If all frequencies have not been tried, the trainable transceiver transmits a ping signal to the remote device using the selected frequency (step 96). The trainable transceiver then listens for an acknowledgement transmission from the remote device (step 98).

If an acknowledgement transmission has been received, the trainable transceiver stores the transmission (e.g., ping signal) frequency in memory as corresponding to a channel used by the remote device (step 100). The trainable transceiver does not inspect, determine, or otherwise use the content of the acknowledgement signal in some embodiments. The trainable transceiver may then repeat the same steps having selected a new frequency.

If an acknowledgement signal is not received, the trainable transceiver can determine if the trainable transceiver has timed out (step 102). If a predetermined amount of time has not passed, the trainable transceiver continues to attempt to receive an acknowledgement signal. If the trainable transceiver has timed out, the trainable transceiver selects a new frequency (step 104) and may repeat the same steps having selected a new frequency.

Figures 4A, 4B:
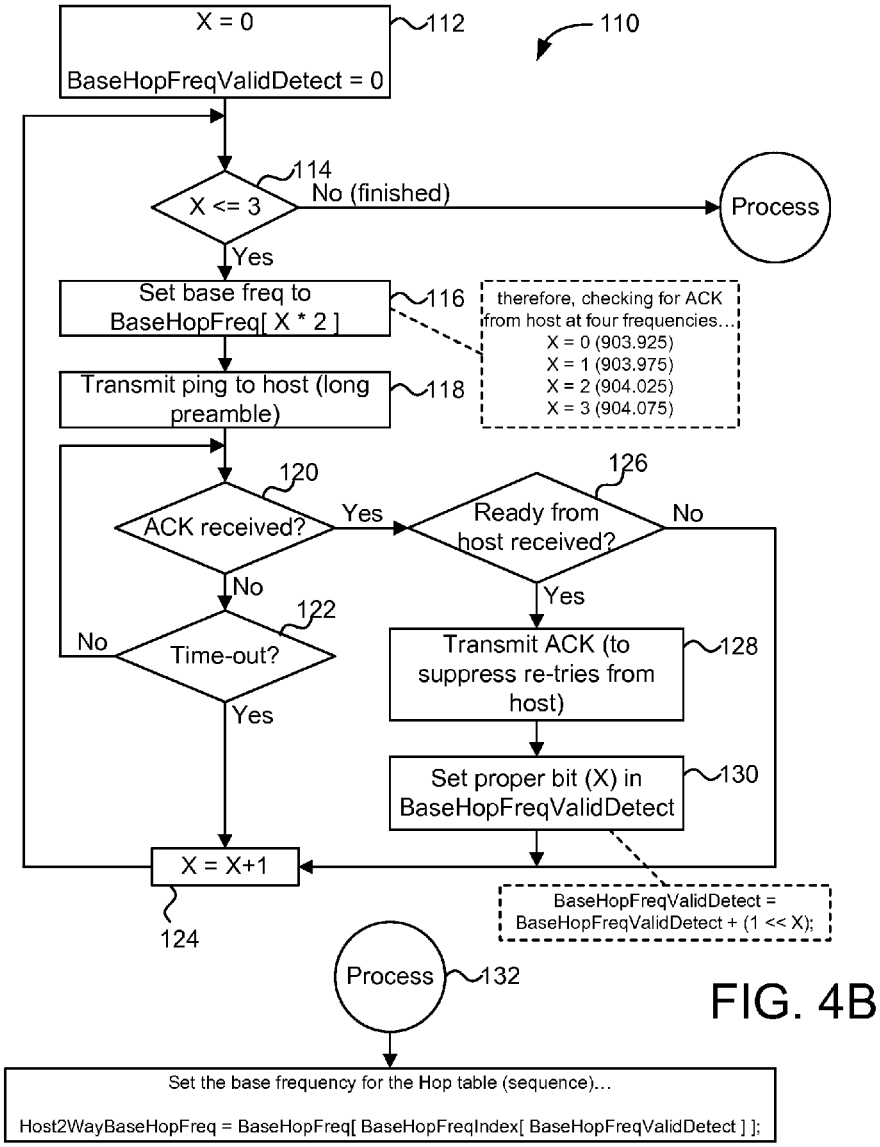
FIG. 4A illustrates an example of variables used in an exemplary process for identifying a frequency offset based on transmissions to a device and received acknowledgement signals from the device.
FIG. 4B illustrates an example of the steps used in an exemplary process for identifying a frequency offset based on transmissions to a device and received acknowledgement signals from the device.

Referring now to FIGS. 4A and 4B, an example of the steps described with reference to FIG. 3 is illustrated. Referring to FIG. 4A, the trainable transceiver may initialize variables for determining the channels used by a device (e.g., using the control circuit, memory, a program, and/or other hardware and software). In some embodiments, the variables are initialized depending on the device to which the trainable transceiver is paired or otherwise receiving transmissions. For example, one or more of the techniques described with reference to FIG. 3 may be used. An array may contain the frequencies which the trainable transceiver will use to determine if the device has a channel corresponding to one or more of the frequencies (e.g., the array may contain the values 903.925 MHz, 903.950 MHz, 903.975 MHz, 904.000 MHz, 904.025 MHz, 904.050 MHz, and 904.075 MHz as illustrated). The array of frequencies may be stored in a variable (e.g., BaseHopFreq with a length of 7). A variable may be used to store a binary number used in selecting a particular frequency. For example, BaseHopFreqValidDetect may be a binary variable containing 4 bits. An additional variable (e.g., BaseHopFreqIndex) may be used to convert the binary variable (e.g., BaseHopFreqValidDetect) to a number (e.g., single precision floating point format).

Referring now to FIG. 4B, the trainable transceiver may use the illustrated example algorithm 110 to determine a channel frequency used by a home electronics device, remote device, or other device. In some embodiments, the algorithm 110 (including the variable initialization discussed with reference to FIG. 4A) is run in response to a user input placing the trainable transceiver in a training mode. In other embodiments, the algorithm 110 is run in response to the trainable transceiver pairing with a device to which the trainable transceiver has not been previously paired with. Alternatively, the trainable transceiver may run the algorithm 110 in response to receiving a transmission from a device for which the trainable transceiver does not have actual channel frequency information stored in memory. Other inputs, events, triggers, or occurrences may cause the trainable transceiver to run the algorithm 110. The trainable transceiver may initialize a variable x and/or set the value of a variable x equal to 0 (step 112). The variable x may act as a counter. The value of BaseHopFreqValidDetect may be set to 0. This may include setting all four bits of the variable to 0.

The trainable transceiver may then determine if the counter is less than or equal to 3 (step 114). If the counter x is less than or equal to 3, the trainable transceiver may set the frequency to be used in a transmission (e.g., base freq) based on the counter value multiplied by 2 (step 116). The counter may be multiplied by 2 and the value in the corresponding position of the array BaseHopFreq returned as the frequency to be used in the transmission. For example, during the first iteration of the algorithm x is equal to 0, 0 multiplied by 2 is 0, and the value returned from the 0 position of BaseHopFreq will be 903.925 MHz. This value will be the frequency at which the transmission is made to the device. As illustrated, the threshold value of the counter (e.g., x less than or equal to 3) and the length of variables initialized as in FIG. 4A are such that the algorithm 110 will perform four iterations and check four frequencies. Other numbers of iterations are possible by altering threshold value of the counter and/or the length of the variables used.

The trainable transceiver may then transmit a ping to the host (step 118). The host may be a home electronics device, remote device, or other device. The ping may be a transmission sent using the transceiver circuit and including modulated data (e.g., data modulated onto a carrier wave at the base freq by the transceiver circuit). The ping transmitted to the device may include or be a long preamble. The ping may be or include other components such as a short preamble, a payload, header, and/or other packet structures. The ping may include information requesting an acknowledgement signal to be sent to the trainable transceiver by the device receiving the ping transmission.

As explained with reference to FIG. 3, the trainable transceiver may then determine if an acknowledgement has been received from the device (step 120). If no acknowledgement has been received, the trainable transceiver may determine if there has been a time-out (step 122). If there has not been a time-out, the trainable transceiver may again determine if an acknowledgement from the device has been received. This loop may continue until either the trainable transceiver determines that there has been a time-out or the trainable transceiver determines that an acknowledgement from the device has been received. If the trainable transceiver determines that a time-out has occurred, the trainable transceiver may add 1 to the value of the counter (step 124) and begin a new iteration by determining if the counter is less than or equal to the threshold value of the counter.

If the trainable transceiver determines that an acknowledgement has been received from the device, the trainable transceiver may determine if the acknowledgement signal included a ready message from the host (e.g., the home electronic device, remote device, or other device) (step 126). If the acknowledgement signal from the device does not include a ready message, the trainable transceiver may add 1 to the value of the counter (step 124) and begin a new iteration by determining if the counter is less than or equal to the threshold value of the counter.

If the trainable transceiver determines that the acknowledgement signal from the device includes a ready message, the trainable transceiver may transmit an acknowledgement signal to the device (e.g., as discussed with reference to FIG. 3) (step 128). The acknowledge signal transmitted to the device may suppress re-tries from the host (e.g., the acknowledgement signal may be received by the device and cause the device to stop sending acknowledgement signals to the trainable transceiver in response to the ping transmission).

The trainable transceiver may then set the value of the bit in the x position of the array of the variable BaseHopFreqValidDetect (step 130). For example, on the first iteration x is equal to 0, therefore the trainable transceiver will set the value of the first bit in the variable BaseHopFreqValidDetect. As illustrated, the bit value may be set according to a Boolean operator which compares the value of x to 1. If x is greater than 1, then the bit value will be set to 1 (e.g., the Boolean operation returns a result of true). If x is less than 1, then the bit value will be set to 0 (e.g., the Boolean operation returns a result of false). As the process 132 goes through all four iterations, BaseHopFreqValidDetect will have all four bits set using this process 132. Four bits corresponds to 16 possible decimal numbers which is the length of BaseHopFreqIndex. For an iteration in which a time-out occurs or the trainable transceiver determines that the acknowledgement signal from the device does not include a ready message, the bit value corresponding to the counter value for the iteration may remain 0. In other words, BaseHopFreqValidDetect is initialized with 0 values and the algorithm does not change the value.

After the bit value is set for BaseHopFreqValidDetect based on the counter value, the trainable transceiver may add 1 to the value of the counter and begin a new iteration by determining if the counter is less than or equal to the threshold value of the counter.

Once the counter reaches a value greater than the threshold value of the counter (e.g., x is equal to 4), the trainable transceiver may determine the frequency of the channel or frequency used by the device. This process is carried out by retrieving the value from the BaseHopFreqIndex in the position given by the value of BaseHopFreqValidDetect. For example, the binary value of the four bits of BaseHopFreqValidDetect corresponds is a number which gives one of 16 possible positions in the variable BaseHopFreqIndex. After retrieving the value in the position of BaseHopFreqIndex based on BaseHopFreqValidDetect, the trainable transceiver uses that value (e.g., a number greater than or equal to 0 and less than or equal to 6) to retrieve a frequency in the corresponding position of BaseHopFreq. This frequency is the frequency at which the device communicates, or, in other words, the frequency is one of the frequencies or the frequency used by the device.

In some embodiments, the frequency returned by the above described process is stored for use by the trainable transceiver. For example, the frequency returned by the process may be stored in memory along with information identifying the associated device. When the trainable transceiver receives an input to communicate with the device, the trainable transceiver may retrieve the frequency from memory and use the frequency to communicate with the device (e.g., format an activation signal to use the frequency). This may allow a trainable transceiver to communicate with a device having a frequency offset (e.g., an actual frequency used in communication which is different from the frequency listed in the specification for the device).

In other embodiments, the frequency returned from the process is used to determine a frequency offset and apply the frequency offset to all of the expected channel values for the device. This may allow a trainable transceiver to communicate with a device having a frequency offset and which uses multiple channels for communication. For example, the trainable transceiver may set the base frequency for a Hop table using the frequency determined using the above described process. The frequency offset may be determined by taking the difference of the expected channel frequency and the actual channel frequency as determined by the algorithm discussed above. The frequency offset, alone or in combination with the base frequency determined by the process discussed above and/or the expected channel values, may be used to determine the actual frequency of all the channels used by the device. For example, the frequency offset may be applied to all expected channel values to give the actual values for each channel used by the device (e.g., as explained with reference to FIG. 3). In alternative embodiments (e.g., where the device uses multiple channels but the frequency offset may differ for each channel), the process discussed above may be repeated with different frequency values (e.g., different values of BaseHopFreq). The other values may correspond to frequency values near the expected values of an additional channel used by the device. The results of the process may be the actual frequency for the additional channel. The process may be repeated for each expected channel with frequency values to test for acknowledgement by the device based on the expected value of the channel. Thus, the process may be repeated to identify the actual values of all channels used by the device.

In some embodiments, the process includes more than four iterations or fewer than 4 iterations. The threshold value of the counter may be greater or less than 3. Additionally, the lengths of BaseHopFreqIndex and BaseHopFreq may be increased or decreased along with the threshold value of the counter in order to test a greater or fewer number of frequencies. For example, more frequencies may be tested within the same range of frequencies in order to increase the accuracy of the process. The number of frequencies tested may be decreased in order to decrease the number of iterations. This may decrease the time for determining the frequency or frequencies used by the device. The bandwidth used by the trainable transceiver to communicate with the device may be increased in order to mitigate the decreased accuracy of using fewer iterations.

Generally, the bandwidth of the transmission from the trainable transceiver to a home electronics device, remote device, or other device may be increased in order to compensate for the frequency offset of the device in other embodiments. For example, the trainable transceiver may increase the bandwidth using the transceiver circuit. In some embodiments, the bandwidth is increased by an amount dependent on the make and model of the device to which the trainable transceiver is transmitting. For example, different makes and/or models of devices may have different maximum frequency offsets (e.g., as determined by tolerances in the specification, as determined experimentally based on the devices, etc.). The trainable transceiver may be provided with the maximum frequency offset for a particular device (e.g., the value may be stored in memory of the trainable transceiver during manufacture, provided to the trainable transceiver by the device as part of the training process, or otherwise acquired by the trainable transceiver). Using the particular maximum frequency offset for a particular device, the trainable transceiver may adjust the bandwidth by a corresponding amount (e.g., widen the bandwidth to equal the maximum frequency offset). Alternatively, the trainable transceiver may be provided with the bandwidth adjustment corresponding to each device rather than the maximum frequency offset value for each device.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A trainable transceiver for controlling a device, comprising:

a transceiver circuit;

a control circuit coupled to the transceiver circuit; and memory coupled to the control circuit, wherein the control circuit is configured to:

receive a signal from the device via the transceiver circuit;

determine a first frequency of a channel used by the device based on the signal strength of the signal received from the device;

determine, based on the first frequency, a second frequency; and transmit an activation signal to the device at the second frequency.

2. The apparatus of claim 1, wherein the control circuit is further configured to store the frequency of the channel used by the device in memory.

3. The apparatus of claim 2, wherein the control circuit is further configured to communicate with the device via the transceiver circuit based on the frequency of the channel used by the device stored in memory.

4. The apparatus of claim 2, wherein the control circuit is further configured to transmit an activation signal to the device via the transceiver circuit based on the frequency of the channel used by the device stored in memory.

5. The apparatus of claim 1, wherein the control circuit is configured to receive a plurality of signals from the device via the transceiver circuit.

6. The apparatus of claim 5, wherein the control circuit is configured to determine a signal strength of each of the signals of the plurality of signals and store, in memory, a frequency corresponding to a signal with the greatest signal strength.

7. The apparatus of claim 1, wherein the control circuit is configured to compare the determined frequency of a channel used by the device to an expected frequency of the channel used by the device, and wherein the control circuit is configured to determine a frequency offset based on the comparison.

8. At a trainable transceiver for controlling a device, a method comprising:

receiving a transmission for the device at a transceiver circuit;

determining the signal strength of the transmission using a control circuit coupled to the transceiver circuit;

determining a first frequency of a channel used by the device using the control circuit and based on the determined signal strength;

determining, based on the first frequency, a second frequency; and transmitting, by the transceiver circuit, an activation signal to the device at the second frequency.

9. The method of claim 8, further comprising storing the frequency of a channel used by the device in memory coupled to the control circuit.

10. The method of claim 9, further comprising sending a transmission to the device using the frequency of a channel used by the device stored in memory.

11. The method of claim 8, wherein a plurality of transmissions from the device are received.

12. The method of claim 11, wherein determining the frequency of a channel used by the device includes comparing the determined signal strength for each transmission of the plurality of transmissions.

13. The method of claim 12, wherein the frequencies of a set of channels used by the device are the frequencies of the transmissions with the highest signal strengths.

14. The method of claim 8, further comprising comparing the determined frequency of a channel used by the device to an expected frequency of a channel used by the device.

15. The method of claim 14, further comprising determining a frequency offset based on the comparison of the determined frequency of a channel used by the device to the expected frequency of the channel used by the device.

16. At a trainable transceiver for controlling a device, a method comprising:

(a) transmitting a signal with a first frequency to the device using a transceiver circuit;

(b) determining if an acknowledgement signal has been received by the transceiver circuit using a control circuit coupled to the transceiver circuit;

(c) storing the first frequency in memory coupled to the control circuit in response to determining that an acknowledgement signal has been received; and (d) transmitting an activation signal to the device at the first frequency stored in memory.

17. The method of claim 16, further comprising determining a frequency offset value by comparing the first frequency to an expected frequency used by the device.

18. The method of claim 17, further comprising applying the frequency offset value to all expected frequencies used by the device.

19. The method of claim 16, further comprising determining, using the control circuit, if a time-out has occurred in response to determining that an acknowledgement signal has not been received.

20. The method of claim 16, wherein the content of the acknowledgement signal is not determined.

* * * * *